US007336167B2

(12) United States Patent
Olsen, III et al.

(10) Patent No.: US 7,336,167 B2
(45) Date of Patent: Feb. 26, 2008

(54) INTERROGATING RFID TRANSPONDERS DURING ROTATION OF PALLETIZED ITEMS, SYSTEMS AND METHODS

(75) Inventors: John A. Olsen, III, Cumming, GA (US); David L. Bradley, Alpharetta, GA (US)

(73) Assignee: United Parcel Service of America, Atlanta, GA (US)

( * ) Notice: Subject to any disclaimer, the term of this patent is extended or adjusted under 35 U.S.C. 154(b) by 208 days.

(21) Appl. No.: 11/054,709

(22) Filed: Feb. 9, 2005

(65) Prior Publication Data

US 2006/0187041 A1 Aug. 24, 2006

(51) Int. Cl.
*G08B 1/08* (2006.01)

(52) U.S. Cl. ..... 340/539.1; 340/539.13; 340/572.1; 340/10.1

(58) Field of Classification Search ..... 340/539.1, 340/539.13, 572.1, 572.8, 10.1
See application file for complete search history.

(56) References Cited

U.S. PATENT DOCUMENTS

| | | | | |
|---|---|---|---|---|
| 4,563,863 | A | 1/1986 | Humphrey | |
| 6,362,738 | B1 | 3/2002 | Vega | |
| 6,496,806 | B1 * | 12/2002 | Horwitz et al. | 705/28 |
| 6,992,574 | B2 * | 1/2006 | Aupperle et al. | 340/505 |
| 2002/0130778 | A1 | 9/2002 | Nicholson | |
| 2005/0022470 | A1 | 2/2005 | Focke et al. | |

FOREIGN PATENT DOCUMENTS

| | | | |
|---|---|---|---|
| WO | WO 02/31789 | A1 | 4/2002 |
| WO | WO 03/020591 | A1 | 3/2003 |

OTHER PUBLICATIONS

International Search Report for PCT/US2006/004453, dated Jun. 21, 2006.

Louis Sirico; Numbers That Please the Palate; RFID Operations—News and Views: RFID Operations Helping to Make RFID Technology Work for You; http://www.rfidoperations.com/newsandviews/20050203.html; Issue #14; Feb. 3, 2005; pp. 1-3. Applicant makes no admission that this reference constitutes prior art.

(Continued)

*Primary Examiner*—Daryl C Pope
(74) *Attorney, Agent, or Firm*—Alston & Bird LLP

(57) ABSTRACT

The invention involves reading RFID transponders affixed to items by rotating the items as they are exposed to an RFID reader as may be incorporated in a normal processing, manufacturing or shipping process such as wrapping items in a protective membrane using a system that includes a commercially-available pallet wrapper adapted to be controlled by computer, and with an RFID transponder reading device mounted to the carriage device of the pallet wrapper. The computer interfaces with a programmable logic controller that controls the pallet wrapper and the RFID reader. The computer causes a predetermined number of wraps of the shipping membrane to be wrapped around a portion of items and the pallet to secure the items to the pallet. The RFID tags on the items on the pallet are read as the items rotate near the fixed RFID reader that is mounted to a carriage holding the shipping membrane.

12 Claims, 9 Drawing Sheets

OTHER PUBLICATIONS

Sanjay Sarma; Hewlett-Packard Deploys OATSystems Software for RFID Tracking; Frontline Solutions; http://www.frontlinetoday.com/frontline/content/printContentPopup.jsp?id+97069; pp. 1-2; Dated Jun. 1, 2004; Accessed Feb. 3, 2005. Applicant makes no admission that this reference constitutes prior art.

Jacqueline Emigh; HP to Unveil RFID 'Noisy Lab,' Microsoft Deal; eWeek Enterprise News and Reviews; http://www.eweek.com/print_article2/0,2533,a=142755,00.asp; Dated Jan. 17, 2005; Accessed Feb. 2, 2005; pp. 1-2; Applicant makes no admission that this reference constitutes prior art.

Oat Foundation Suite: OATxpress; OATSystems: Setting the Standard in RFID; http://www.oatsystems.com/products/oatexpress.html; Accessed Feb. 2, 2005. Applicant makes no admission that this reference constitutes prior art.

HP Unveils "Noisy Labs" for RFID Technology Development; HP-Interex.org; http://www.hp-interex.org/site/cms/newsarticleview.asp?article=2694; Dated Jan. 17, 2005; Accessed Feb. 2, 2005; pp. 1-3. Applicant makes no admission that this reference constitutes prior art.

Boy Van Droffelarr; RFID Overview—GCI Board Meeting; Sara Lee; Oct. 13, 2004; pp. 1-24. Applicant makes no admission that this reference constitutes prior art.

Radio Tag (RFID) Systems; Barcoding Incorporated; http://www.barcoding.com/RFID/rfid_reader_options_by_application.shtml; Accessed Feb. 2, 2005; pp. 1-2. Applicant makes no admission that this reference constitutes prior art.

Jeffrey D. Lindsay and Walter Reade; Cascading RFID Tags; JeffLindsay.com; http://www.jefflindsay.com/rfid3.shtml; Dated Nov. 7, 2003; Accessed Feb. 2, 2005; pp. 1-11. Applicant makes no admission that this reference constitutes prior art.

Jason Catchings; The Science of Tag Locations; EPCglobal—Business Action Group—Pilot and Implementation Workgroup Work Stream Practice Briefings; Accessed Jan. 20, 2005; pp. 1-6; Published Texas, USA. Applicant makes no admission that this reference constitutes prior art.

Jos Doran; Compensating for Less Than 100% Case Read Rates; EPCglobal—Business Action Group—Pilot and Implementation Workgroup Work Stream Practice Briefings; Accessed Jan. 24, 2005; pp. 1-7; Published Massachusetts, USA. Applicant makes no admission that this reference constitutes prior art.

RFID Reader Interference—Practical Solutions to a Complex Problem; ODIN Technologies—Trusted RFID Experts; Dated Oct. 2004; pp. 1-6; Published Reston, VA. Applicant makes no admission that this reference constitutes prior art.

The RFID Tagging Guide—Secrets for Handling Difficult to Read Products; ODIN Technologies—Trusted RFID Experts; Dated Oct. 2004; pp. 1-9; Published Reston, VA. Applicant makes no admission that this reference constitutes prior art.

* cited by examiner

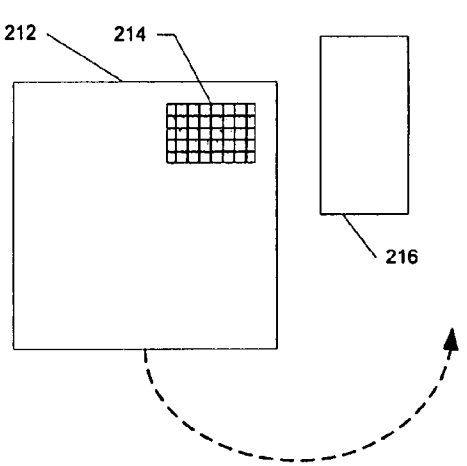
FIG. 2A
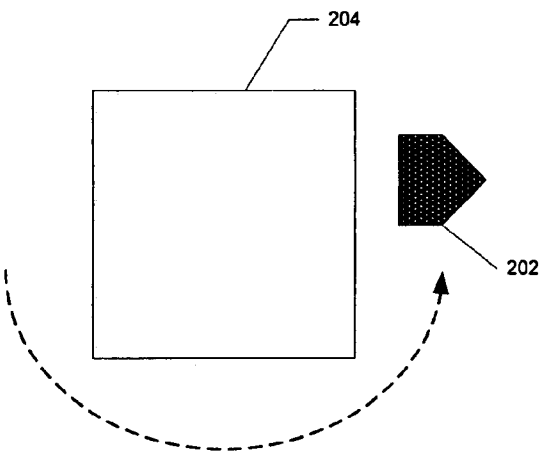
FIG. 2B
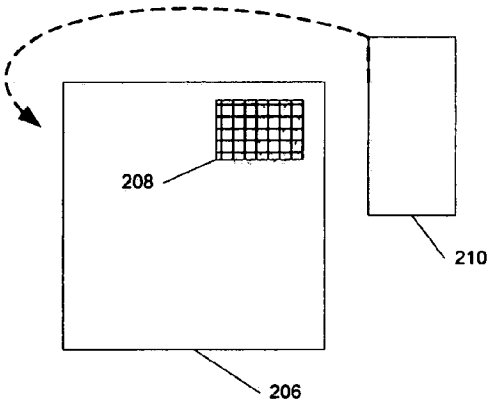
FIG. 2C
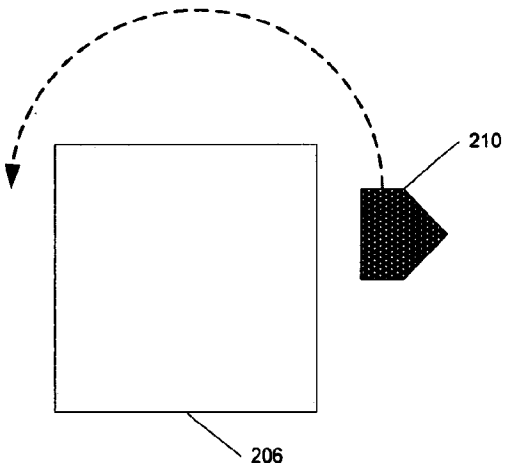
FIG. 2D
FIG. 2E
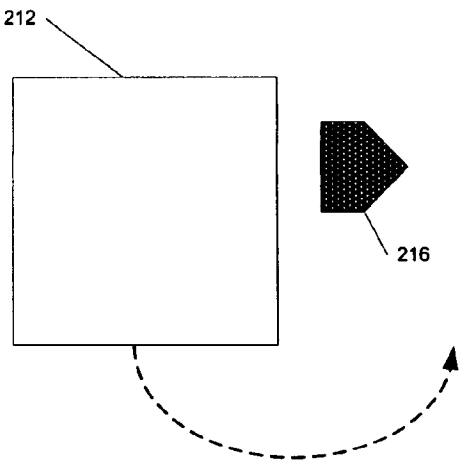
FIG. 2F

INTERROGATING RFID TRANSPONDERS DURING ROTATION OF PALLETIZED ITEMS, SYSTEMS AND METHODS

BACKGROUND OF THE INVENTION

1. Field of the Invention

The field of the invention is the interrogation of radio frequency identification (RFID) transponders. More specifically, the field of the invention is interrogating a known number of RFID transponders associated with items placed on a shipping pallet while such shipping pallet is rotated during a process of applying a shipping membrane to stabilize the items of the shipping pallet or while an RFID reader is rotated substantially about the items.

2. Description of Related Art

Item tracking and identification has advanced with the development of machine-readable indicia such as barcodes and machine-readable devices such as RFID transponders. RFID transponders are beginning to garner more favor as they are capable of providing more information than a barcode and as their costs decrease. Information about an item that may be included in an RFID transponder can include item identification information, stock-keeping information, ownership information, shipping information, etc. In manufacturing, warehousing and shipping environments, items may be associated with RFID transponders to track them as well as to provide information about the model or serial number, location, cost, shipper, recipient, recipient's address, etc. In many instances, items that are tagged (i.e., associated) with an RFID transponder will have their RFID transponder interrogated numerous times as the item makes it way through the manufacturing, warehousing or shipping processes. Essentially, any process that uses automatic identification technologies requires a medium to store information that will subsequently be retrieved by various applications for processing. Such a medium is provided by RFID transponders. Transponders come in a variety of sizes and designs, and there are numerous types, each tailored to meet different application requirements.

RFID transponders (a/k/a "tags") have at least two components, an integrated circuit (IC) chip and an antenna. The chip and antenna can be laminated on plastic cards, encapsulated in protective housings, embedded in label stock, or produced in numerous other ways and forms. The amount of information that may be stored in a RFID tag varies, some tags are able to store significant amounts of information while others are designed to record a single identifier, much like a barcode. Tags also differ in their power sources and how they send/receive information to/from RFID readers.

RFID tags can be classified as either active or passive. This classification describes the tag's power source and how the tag sends information to readers. Active tags have an internal transmitter powered by an onboard battery while passive tags are powered by an external reader's signal. In passive tags, the reader's transmission energizes the tag's antenna, which in turn resonates back a corresponding signal. RFID tags and readers are typically designed to transmit data on a fixed frequency band. Frequency impacts both read rate and distance. Lower frequency tags typically have shorter read distances and slower data transfer rates than higher frequency tags. Passive tags are usually classified depending upon the frequency band in which they operate.

An RFID reader or interrogator retrieves information stored on a tag through a radio frequency signal picked up by the reader's antenna. How this data signal is generated depends on the tag being read. An active reader receives signals broadcast by the tag's internal RF transmitter. Some active tags broadcast their signals continuously without regard to whether there is a reader within receiving range. Other active tags require a prompt signal from a reader before broadcasting their data stream.

A passive reader transmits a signal strong enough to energize the target tag's antenna and circuitry. The tag resonates the signal back to the reader in a slightly modified form that is decoded to extract the data stream. Since they provide the energy for the tag's transmission, passive readers must have a considerably more powerful signal than active readers. An RFID reader is capable of reading multiple tags within its transmission field.

RFID readers come in two basic configurations: mobile and fixed. Mobile readers are usually employed as peripheral devices on handheld or vehicle mounted terminals. Fixed readers may support one or more external antennas. The reader and antenna may also be contained in a single housing.

A challenge faced when using either a fixed reader or a mobile one is orienting the reader and/or the RFID tag such that the RFID is read. For instance, in fixed installations, items associated with tags may need to be oriented such that they face the reader for optimal readability or multiple readers are required. This is especially true if the item is comprised of a liquid or has a metallic container as these materials may attenuate the RF signal used by the RFID tag and reader. Likewise, it may be difficult to orient a mobile reader such that the RFID tag associated with that item is read, especially in high-speed environments experienced in manufacturing and shipping. Another challenge faced in today's manufacturing, shipping and processing environments is quickly and accurately reading an RFID tag without adding an additional delay to the process.

For instance, as described in U.S. Pat. No. 6,335,685 issued to Gabriel et al. on Jan. 1, 2002, items having RFID tags attached thereto are either moved linearly and horizontally in front of a RFID reader with the RFID tags on the items oriented towards the reader or non-moving items are read by activating the RFID tag with a laser device, thus in both instances requiring orientation of the RFID tag toward the laser or toward the reader.

An unsatisfied need therefore exists for quickly and accurately reading RFID transponders associated with items that overcomes the challenges described above and others mentioned herein.

BRIEF SUMMARY OF THE INVENTION

The embodiments of the present invention involves systems and methods of reading RFID affixed to items by rotating the items while holding an RFID reader at a fixed position or moving an RFID reader, or at least the antenna of an RFID reader, substantially vertically relative to the items. This reading may be incorporated in a normal processing step of a manufacturing or shipping process such as wrapping the item or items in a shipping or protective film.

The embodiments of the present invention involves a system of a commercially-available pallet wrapper that is adapted to be controlled by a computing device such as, for example, a point of sale (POS) computer, and with an RFID transponder reading device (e.g., antenna) mounted to the carriage device of the pallet wrapper. The POS computer is connected to a programmable logic controller that controls the pallet wrapping machine. The RFID reader is connected to the POS computer. The POS computer also receives as an input at least the number of items having RFID transponders that are on a pallet to be wrapped. In one embodiment the pallet is equipped with a RFID transponder or a barcode such that in an automated system the pallet's RFID tag or barcode could be read and associated with the RFID tag of each item placed on that pallet and this information stored in a database such that when the pallet is received at the wrapping area, the pallet's RFID tag or barcode is read and the wrapping system will have access to the database where the pallet and item information is stored and thus the system will be able to determine the number of items that are supposed to be on that pallet. The POS computer will then cause the wrapper to wrap a predetermined number of wraps of the shipping membrane around the bottom portion of items and the pallet to secure the items to the pallet. The RFID reader mounted on the carriages begins reading as the pallet is rotated during the wrapping process. The RFID tags on the items on the pallet are read as the pallet rotates near the fixed RFID reader that is mounted to the carriage that holds the shipping membrane. Once the bottom portion of the items and the pallet are wrapped, the carriage will automatically (as controlled by the POS computer) move vertically to the top portion of the items mounted on the pallet as the pallet continues to rotate. As the carriage moves vertically, the RFID reader will continue to read the RFID tags of the items on the pallet. The wrapper will then wrap the items on the pallet from the top down as programmed by the POS computer. The RFID reader will continue to read the RFID tags of the items on the pallet until all the tags have been read or the wrapping process is complete. The RFID wrapper will notify the POS computer of each RFID tag that is read (ignoring duplicates) such that the known number of items having RFID tags on the pallet can be compared to the number of RFID tags that have been read to determine when all of the tags for a particular pallet have been read. In other embodiments, the reader may move up and down vertically on the carriage while the pallet rotates if all of the known RFID tags for a particular pallet were not read. Wrapping may or may not occur during this process.

One aspect of the invention is a system for reading RFID transponders. The system includes one or more items each having at least one RFID transponder associated therewith or affixed thereto, one or more RFID readers capable of reading encoded information on each of the RFID transponders, and a rotational device capable of rotating in the horizontal plane. The one or more items each having at least one RFID transponder associated therewith or affixed thereto are placed upon the rotational device and rotated while the one or more RFID readers remain at a fixed point in the horizontal plane and read information from the RFID transponders.

Another aspect of the invention is a system for reading RFID transponders. The system includes one or more items each having at least one RFID transponder associated therewith or affixed thereto that are placed on a pallet, one or more RFID readers capable of reading encoded information on each of the RFID transponders, and a pallet wrapper. The pallet wrapper is comprised at least in part by a rotational device capable of rotating in the horizontal plane and a carriage device that moves in a vertical plane. The carriage device holds a shipping membrane that is wrapped at least in part about the pallet and the items as they are rotated on the rotating device. At least one of the RFID readers is attached to the carriage device and the pallet with one or more items each having at least one RFID transponder associated therewith or affixed thereto are placed upon the rotational device and rotated while the one or more RFID readers remain at fixed points in the horizontal plane and read information from the RFID transponders.

Another aspect of the invention is an improved pallet-wrapping apparatus. The improved pallet wrapping apparatus includes a rotational platform that rotates in a horizontal plane. One or more items at least a portion of which are associated with RFID transponders are placed on a pallet and the pallet along with the items is placed on the rotational platform. The improved pallet wrapping apparatus further includes a programmable logic controller adapted to control the pallet wrapping apparatus and a computer that interfaces with at least the programmable logic controller. The computer includes a display capable of displaying operating characteristics of the pallet wrapping apparatus and an input device for receiving operating instructions for the pallet wrapping apparatus. The improved pallet wrapping device also includes a carriage device. The carriage device moves in a vertical plane and the carriage device holds a shipping membrane that is wrapped at least in part about the pallet and the items as they are rotated on the rotational platform. The carriage device further has attached thereto at least one RFID reader. The pallet with the items having RFID transponders associated therewith are placed upon the rotational platform and rotated while the at least one RFID reader reads information from the RFID transponders until all the RFID transponders on the pallet have been read or until a predetermined time limit has passed.

Another aspect of the invention is a method of reading RFID transponders. The method includes the steps of providing one or more items having affixed RFID transponders, providing at least one RFID reader at a fixed position in a horizontal plane, and placing the one or more items on a rotational device and simultaneously rotating said items about an imaginary axis approximately through the midpoint of the one or more items and reading the affixed RFID transponders with the at least one RFID reader.

Another aspect of the invention is a method of reading RFID transponders. The method includes the steps of providing one or more items having affixed RFID transponders, providing at least one RFID reader at a fixed position in the horizontal plane, and placing the one or more items on a rotational device and simultaneously rotating the items substantially about the at least one RFID reader and reading the affixed RFID transponders with the at least one RFID reader.

Another aspect of the invention is a method of reading RFID transponders. The method is comprised of the steps of providing one or more items having affixed RFID transponders, providing at least one RFID reader, and rotating the at least one RFID reader substantially about the items in a horizontal plane and reading the affixed RFID transponders with the at least one RFID reader.

Another aspect of the invention is a method of reading RFID transponders. The method is comprised of the steps of providing one or more items and affixing at least one RFID transponder to each of said one or more items, placing the one or more items on a pallet, providing at least one RFID reader at a fixed position in a horizontal plane, placing the pallet with said one or more items on a rotational device and simultaneously rotating the items about an imaginary axis approximately through the midpoint of the one or more items and reading the affixed RFID transponders with the at least one RFID reader, and rotating the pallet with the one or more items and reading the RFID transponders until all the RFID transponders affixed to the one or more items have been read or until a predetermined time limit has passed.

Another aspect of the invention is a method of reading RFID transponders. The method is comprised of the steps of providing one or more items and affixing at least one item RFID transponder to each of the one or more items, placing the one or more items on a pallet where the pallet has an affixed pallet RFID transponder, electronically linking the one or more item RFID transponders to the pallet RFID transponder, providing at least one RFID reader at a fixed position in a horizontal plane, placing the pallet with the one or more items on a rotational device, reading the pallet RFID transponder and determining a pallet item count that is equal to the item RFID transponders that are linked to the pallet RFID transponder, wrapping a shipping membrane around at least a portion of the pallet and said items while simultaneously reading the item RFID transponders with the at least one RFID reader while the pallet and the items are rotated on the rotational device in a horizontal plane about an imaginary axis approximately through the midpoint of the one or more items and reading the affixed RFID transponders with the at least one RFID reader until the wrapping is complete, and comparing the number of item RFID transponders read to the count and signaling an alert or continuing reading the item RFID transponders if the number of item RFID transponders is not equal to the count.

The embodiments of the present invention provide a efficient and cost-effective means of reading RFID transponders on one or more items as such items may be processed through the mechanisms of a parcel delivery service. The above aspects of the present invention and other additional aspects are described more thoroughly below.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 1*a* is an illustration of one embodiment of a computer that can be used to practice aspects of the present invention;

FIG. 1*b* is an embodiment of a processing system having a distributed communication and processing architecture that may be used to practice aspects of the present invention;

FIG. 2A is a profile view of an embodiment of the invention where an RFID reader remains stationary while an item having an affixed RFID tag is rotated in a horizontal plane near the RFID reader to facilitate the reading of the RFID tag;

FIG. 2B is a plan view of the item and the RFID reader as shown in the embodiment of FIG. 2A, which illustrates the rotation of the item 204 while the RFID reader remains stationary;

FIG. 2C is a profile view of an embodiment of the invention where an item having an affixed RFID tag remains stationary while an RFID reader rotates or orbits substantially about the item to facilitate the reading of the RFID tag;

FIG. 2D is a plan view of the item and the RFID reader as shown in the embodiment of FIG. 2C, which illustrates the rotation of the RFID reader substantially about the item while the item remains stationary;

FIG. 2E is a profile view of an embodiment of the invention where an item having an affixed RFID tag is rotated substantially about a stationary RFID reader to facilitate the reading of the RFID tag;

FIG. 2F is a plan view of the item and the RFID reader as shown in the embodiment of FIG. 2E, which illustrates the rotation of the item substantially about the RFID reader while the RFID reader remains stationary;

Figure 6A:
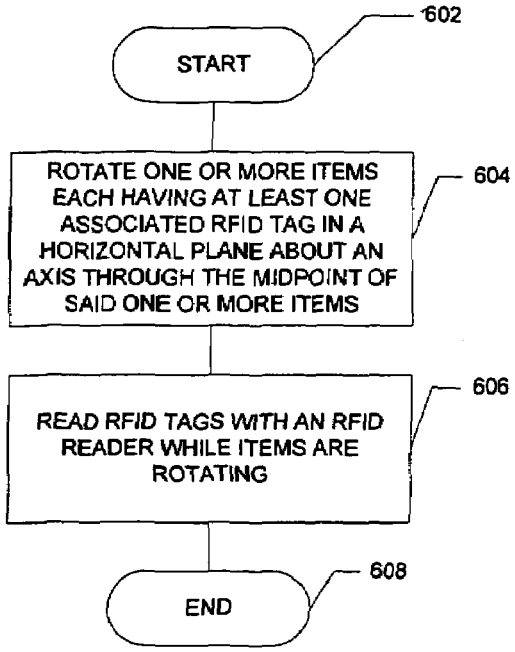
FIG. 6A is a flowchart that describes an embodiment of a method of an invention for reading RFID tags associated with one or more items as such items are rotated about an axis located substantially at the midpoint of the one or more items.
Figure 6B:
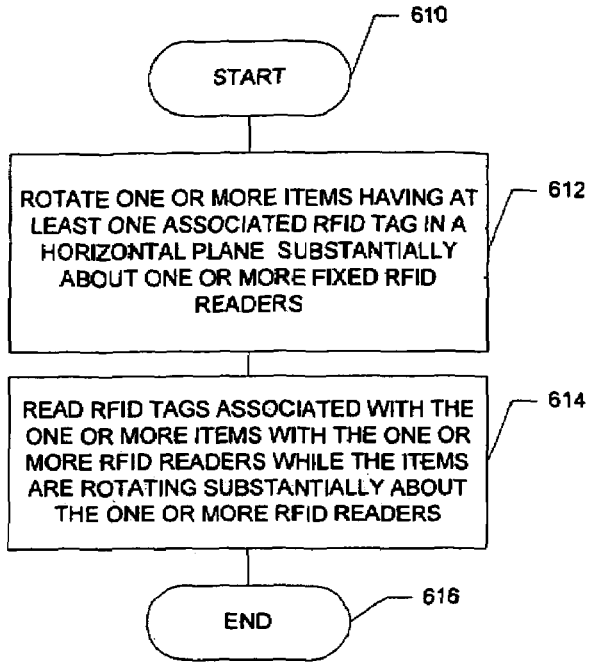
FIG. 6B is a flowchart that describes an embodiment of a method of an invention for reading RFID tags associated with one or more items as such items are rotated in a horizontal plane substantially about or ore more fixed RFID tags.
Figure 6C:
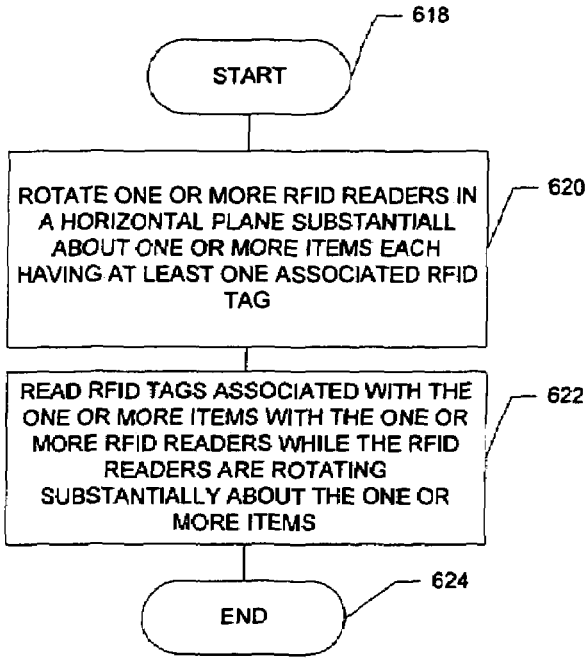
Figure 7:
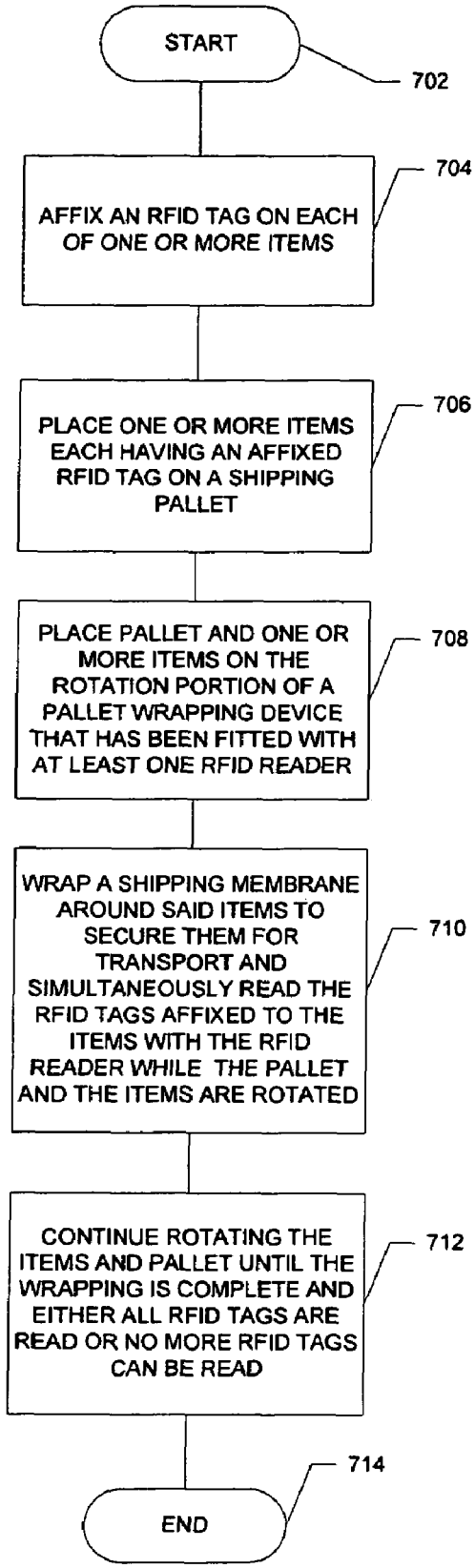
Figure 8:
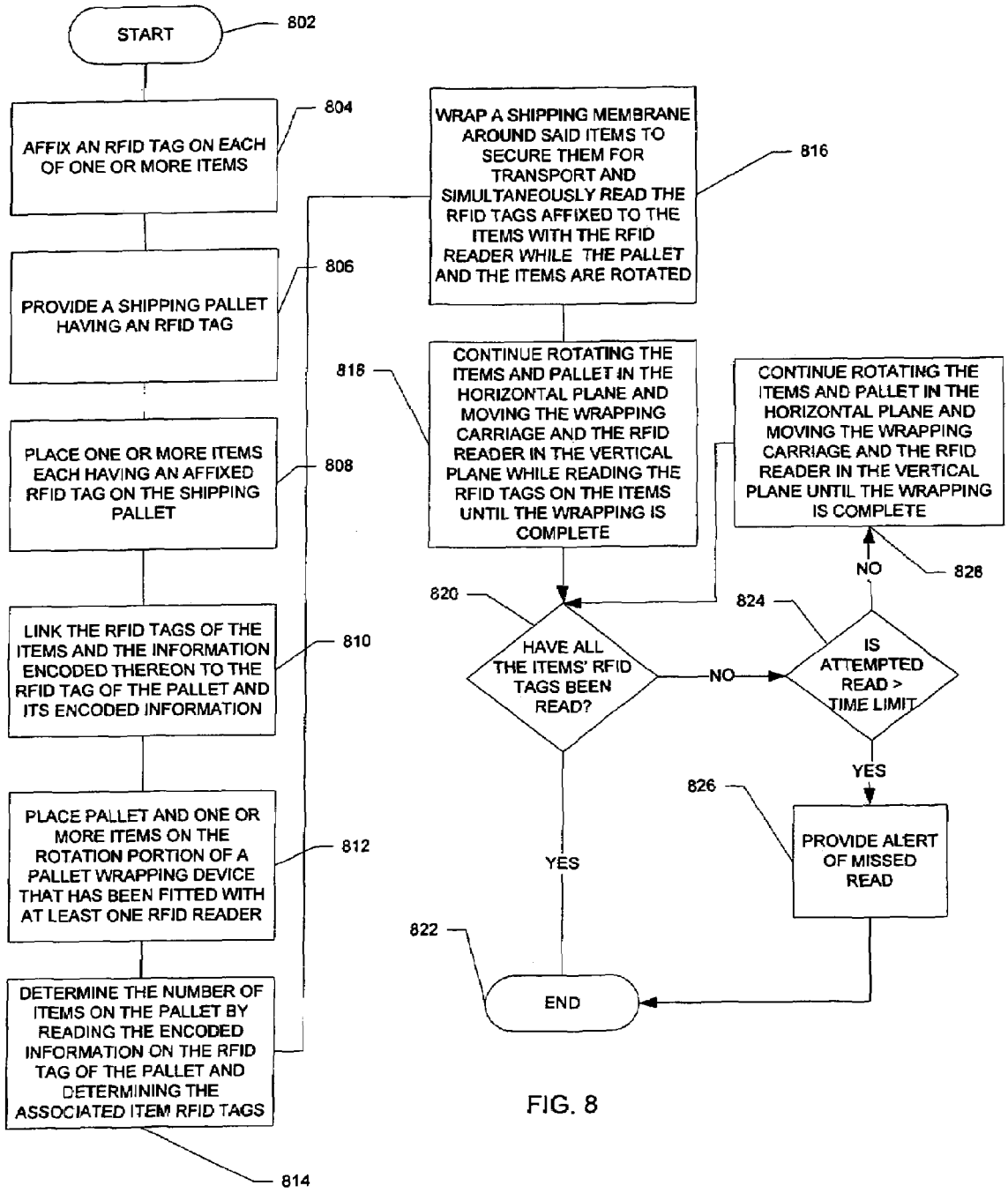

FIG. 6C is a flowchart that describes an embodiment of a method of an invention for reading RFID tags associated with one or more items as one or more RFID readers are rotated in a horizontal plane substantially about the one or more items FIG. 7 is a flowchart that describes an embodiment of a method of an invention for reading RFID tags associated with one or more items as such items are rotated; and FIG. 8 is flowchart that describes an embodiment of a method of an invention for reading RFID tags associated with one or more items as such items are rotated.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention is described below with reference to block diagrams and flowchart illustrations of methods, apparatuses (i.e., systems) and computer program products according to an embodiment of the invention. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions that execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

The embodiments of the present invention are directed toward systems and methods of reading radio frequency identification (RFID) transponders (a/k/a "tags") while rotating an item to which an RFID tag is affixed or associated. An application of the embodiments of the present invention is to adapt a commercially-available pallet wrapper or stretch wrapper with an RFID reader or an antenna of an RFID reader on the carriage of the wrapper such that when the item or items being wrapped are rotated to apply the shipping or protective membrane, RFID tags attached to the item or items are read by the reader or the reader's antenna. In another embodiment, the carriage of the wrapper moves in a vertical plane while the item or items are rotated in a horizontal plane while the reading of the RFID tags occurs. In yet another embodiment, the carriage of the wrapper and thus the RFID reader or its antenna substantially encircles a stationary item or items while reading RFID tags associated or affixed to the item or items. In one embodiment, the carriage may move in the vertical plane as it substantially encircles the item or items. Further embodiments include a programmable logic controller that is adapted to control the reading and wrapping of the pallet wrapper or stretch wrapper. The programmable logic controller (PLC) may interface with a computer such that the PLC and thus the wrapper may receive programmed instructions from the computer. The computer may also interface with other process controls in a facility to automate the reading of the RFID tags and the wrapping of the items.

Figure 1A:
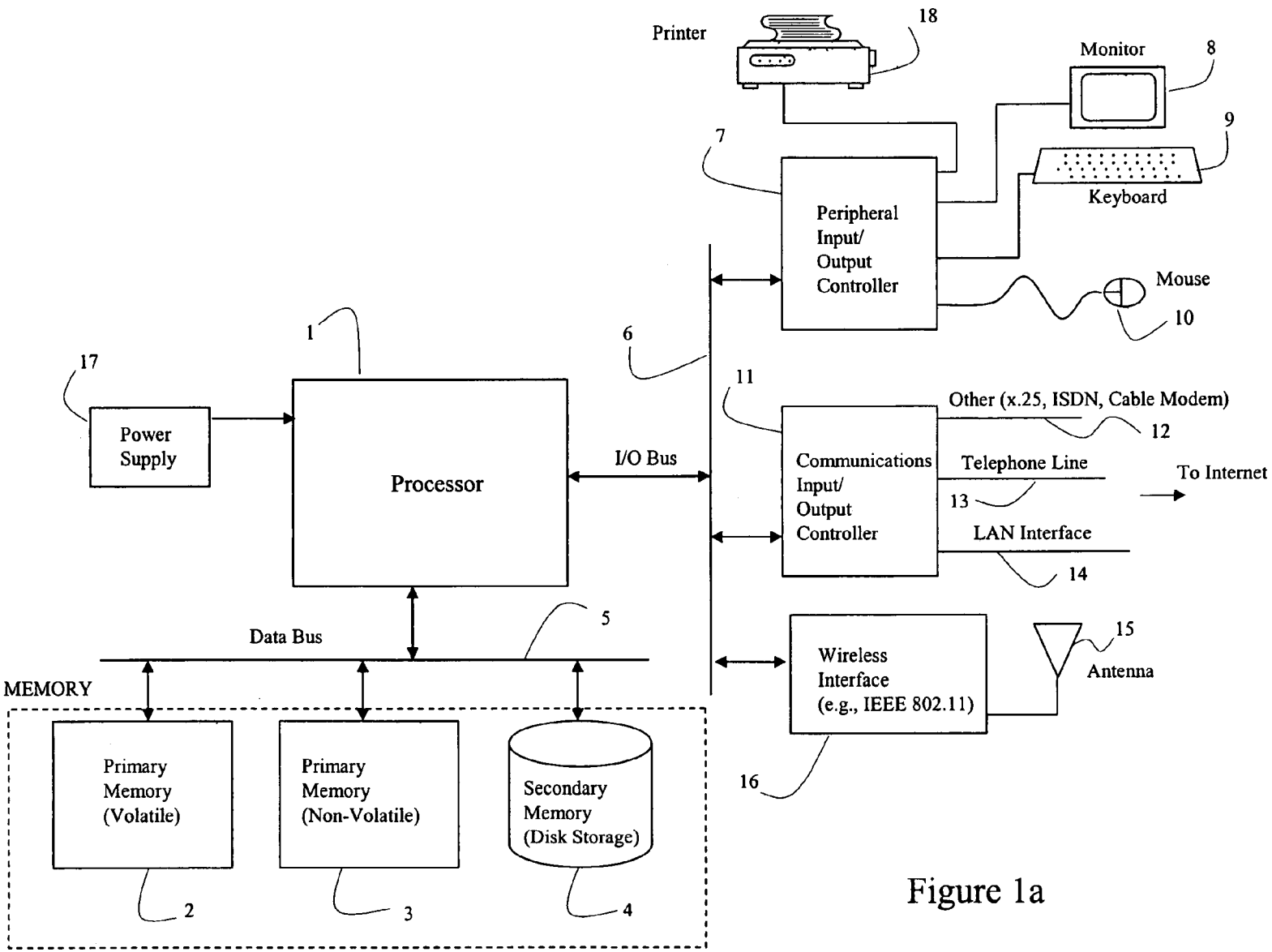

In several of the embodiments referenced herein, a "computer" is referenced. The computer may be, for example, a mainframe, desktop, notebook or laptop, hand-held, etc. In some instances the computer may be a "dumb" terminal used to access data or processors over a network. Turning to FIG. 1*a*, one embodiment of a computer is illustrated that can be used to practice aspects of the present invention. In FIG. 1*a*, a processor 1, such as a microprocessor, is used to execute software instructions for carrying out the defined steps. The processor receives power from a power supply 17 that also provide power to the other components as necessary. The processor 1 communicates using a data bus 5 that is typically 16 or 32 bits wide (e.g., in parallel). The data bus 5 is used to convey data and program instructions, typically, between the processor and memory. In the present embodiment, memory can be considered primary memory 2 that is RAM or other forms which retain the contents only during operation, or it may be non-volatile 3, such as ROM, EPROM, EEPROM, FLASH, or other types of memory that retain the memory contents at all times. The memory could also be secondary memory 4, such as disk storage, that stores large amount of data. In some embodiments, the disk storage may communicate with the processor using an I/O bus 6 instead or a dedicated bus (not shown). The secondary memory may be a floppy disk, hard disk, compact disk, DVD, or any other type of mass storage type known to those skilled in the computer arts.

The processor 1 also communicates with various peripherals or external devices using an I/O bus 6. In the present embodiment, a peripheral I/O controller 7 is used to provide standard interfaces, such as RS-232, RS422, DIN, USB, or other interfaces as appropriate to interface various input/output devices. Typical input/output devices include local printers 18, a monitor 8, a keyboard 9, and a mouse 10 or other typical pointing devices (e.g., rollerball, trackpad, joystick, etc.).

The processor 1 typically also communicates using a communications I/O controller 11 with external communication networks, and may use a variety of interfaces such as data communication oriented protocols 12 such as X.25, ISDN, DSL, cable modems, etc. The communications controller 11 may also incorporate a modem (not shown) for interfacing and communicating with a standard telephone line 13. Finally, the communications I/O controller may incorporate an Ethernet interface 14 for communicating over a LAN. Any of these interfaces may be used to access the Internet, intranets, LANs, or other data communication facilities.

Finally, the processor 1 may communicate with a wireless interface 16 that is operatively connected to an antenna 15 for communicating wirelessly with another devices, using for example, one of the IEEE 802.11 protocols, 802.15.4 protocol, or a standard 3G wireless telecommunications protocols, such as CDMA2000 1× EV-DO, GPRS, W-CDMA, or other protocol.

Figure 1B:
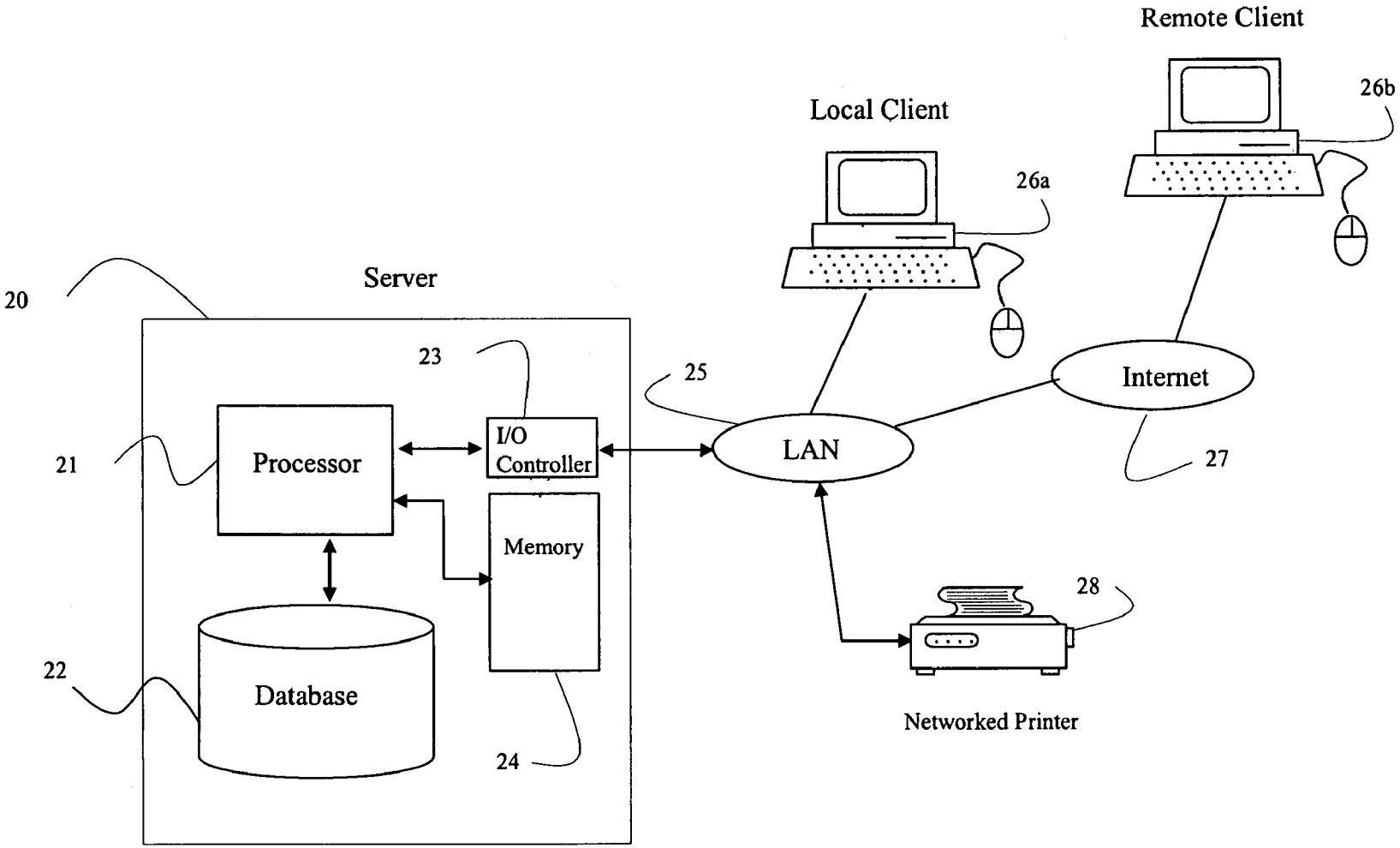

An alternative embodiment of a processing system that may be used is shown in FIG. 1*b*. In this embodiment, a distributed communication and processing architecture is shown involving a server 20 communicating with either a local client computer 26*a* or a remote client computer 26*b*. The server 20 typically comprises a processor 21 that communicates with a database 22, which can be viewed as a form of secondary memory, as well as primary memory 24. The processor also communicates with external devices using an I/O controller 23 that typically interfaces with a LAN 25. The LAN may provide local connectivity to a networked printer 28 and the local client computer 26*a*. These may be located in the same facility as the server, though not necessarily in the same room. Communication with remote devices typically is accomplished by routing data from the LAN 25 over a communications facility to the Internet 27. A remote client computer 26*b* may execute a web browser, so that the remote client 26*b* may interact with the server as required by transmitted data through the Internet 27, over the LAN 25, and to the server 20.

Those skilled in the art of data networking will realize that many other alternatives and architectures are possible and can be used to practice the principles of the present invention. The embodiments illustrated in FIGS. 1*a* and 1*b* can be modified in different ways and be within the scope of the present invention as claimed.

The embodiments of the present invention provide systems and methods of reading RFID tags associated with or affixed to one or more items while such items are rotated substantially in front of or substantially about a RFID reader or the antenna of an RFID reader (the RFID reader or the RFID reader's antenna or the RFID reader and the reader's antenna may be referred to herein as an "RFID reader"), or the RFID reader is rotated substantially about the item or items to which the RFID tags are associated or affixed.

FIG. 2A is a profile view of an embodiment of the invention where a RFID reader 202 remains stationary while an item 204 having an affixed RFID tag 205 is rotated in a horizontal plane near the RFID reader 202 to facilitate the reading of the RFID tag 205. FIG. 2B is a plan view of the item 204 and the RFID reader 202 as shown in the embodiment of FIG. 2A, which illustrates the rotation of the item 204 while the RFID reader 202 remains stationary.

FIG. 2C is a profile view of an embodiment of the invention where an item 206 having an affixed RFID tag 208 remains stationary while an RFID reader 210 rotates or orbits substantially about the item 206 to facilitate the reading of the RFID tag 208. FIG. 2D is a plan view of the item 206 and the RFID reader 210 as shown in the embodiment of FIG. 2C, which illustrates the rotation of the RFID reader 210 substantially about the item 206 while the item 206 remains stationary.

FIG. 2E is a profile view of an embodiment of the invention where an item 212 having an affixed RFID tag 214 is rotated substantially about a stationary RFID reader 216 to facilitate the reading of the RFID tag 214. FIG. 2F is a plan view of the item 212 and the RFID reader 216 as shown in the embodiment of FIG. 2E, which illustrates the rotation of the item 212 substantially about the RFID reader 216 while the RFID reader 216 remains stationary.

DESCRIPTION OF THE SYSTEM

Figure 3A:
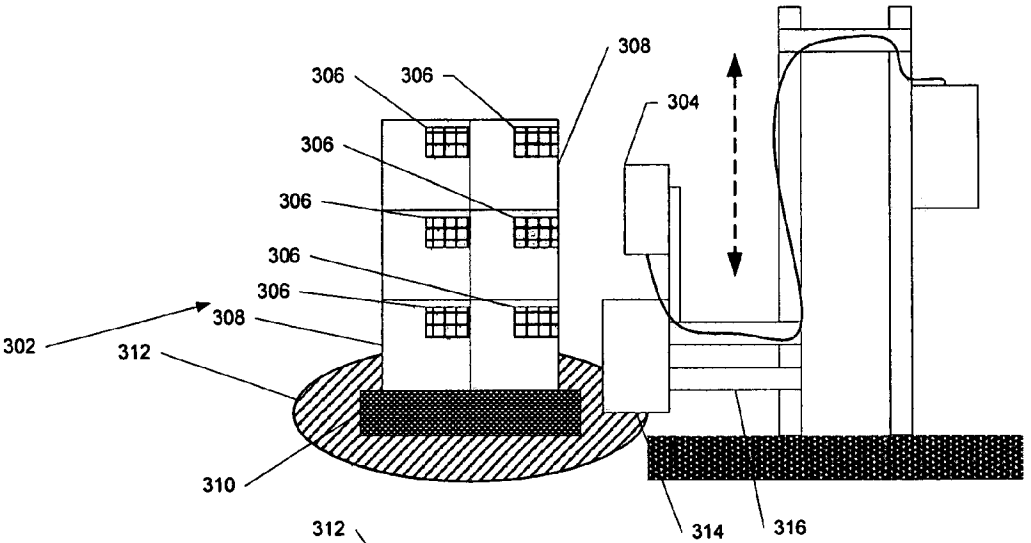
FIG. 3A is a plan view of an exemplary pallet-wrapping device cooperatively adapted with an RFID reader such that RFID tags on items placed on a shipping pallet are read as the items are rotated in a horizontal plane on a turntable while applying a shipping membrane to the items and the pallet to stabilize the items on the pallet and protect them, in an embodiment of the invention.

FIG. 3A is a plan view of an exemplary pallet-wrapping device 302 cooperatively adapted with an RFID reader 304 such that RFID tags 306 on items 308 placed on a shipping pallet 310 are read as the items 308 are rotated in a horizontal plane on a turntable 312 while applying a shipping membrane 314 to the items 308 and the pallet 310 to stabilize the items 308 on the pallet 310 and protect them, in an embodiment of the invention. In the embodiment shown in FIG. 3A, the RFID reader 304 is mounted to a carriage 316 that holds the shipping membrane 314. As the items 308 and pallet 310 are rotated in the horizontal plane to apply the shipping membrane 314, the carriage 316 and thus, the RFID reader 304, move in the vertical plane thereby reading the RFID tags 306 on the items 308 and applying the shipping membrane 314 simultaneously. The rotation of the items 308 facilitates the reading of the RFID tags 306 as the tags 306 are exposed to the RFID reader 304 at various combinations of horizontal and vertical angles as the items 308 rotate and the RFID reader 304 moves in the vertical plane. In other embodiments, not shown, there may be more than one RFID reader and in some instances, the RFID readers may be mounted at stationary positions outside the periphery of the turntable 312.

Figure 3B:
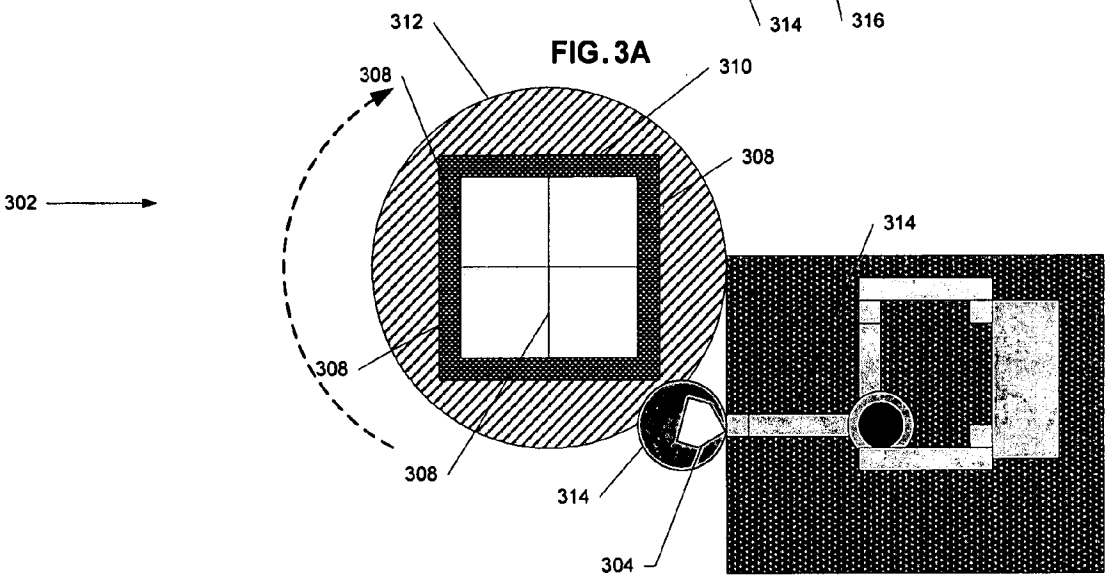
FIG. 3B is a plan view of the exemplary pallet-wrapping device shown in FIG. 3A.

FIG. 3B is a plan view of the exemplary pallet-wrapping device 302 shown in FIG. 3A. The rotation of the turntable 312 causes the items 308 on the pallet 310 to rotate and the carriage 316 moves vertically thus applying the shipping membrane 314 and simultaneously reading the RFID tags 306 associated with the items.

Figure 4:
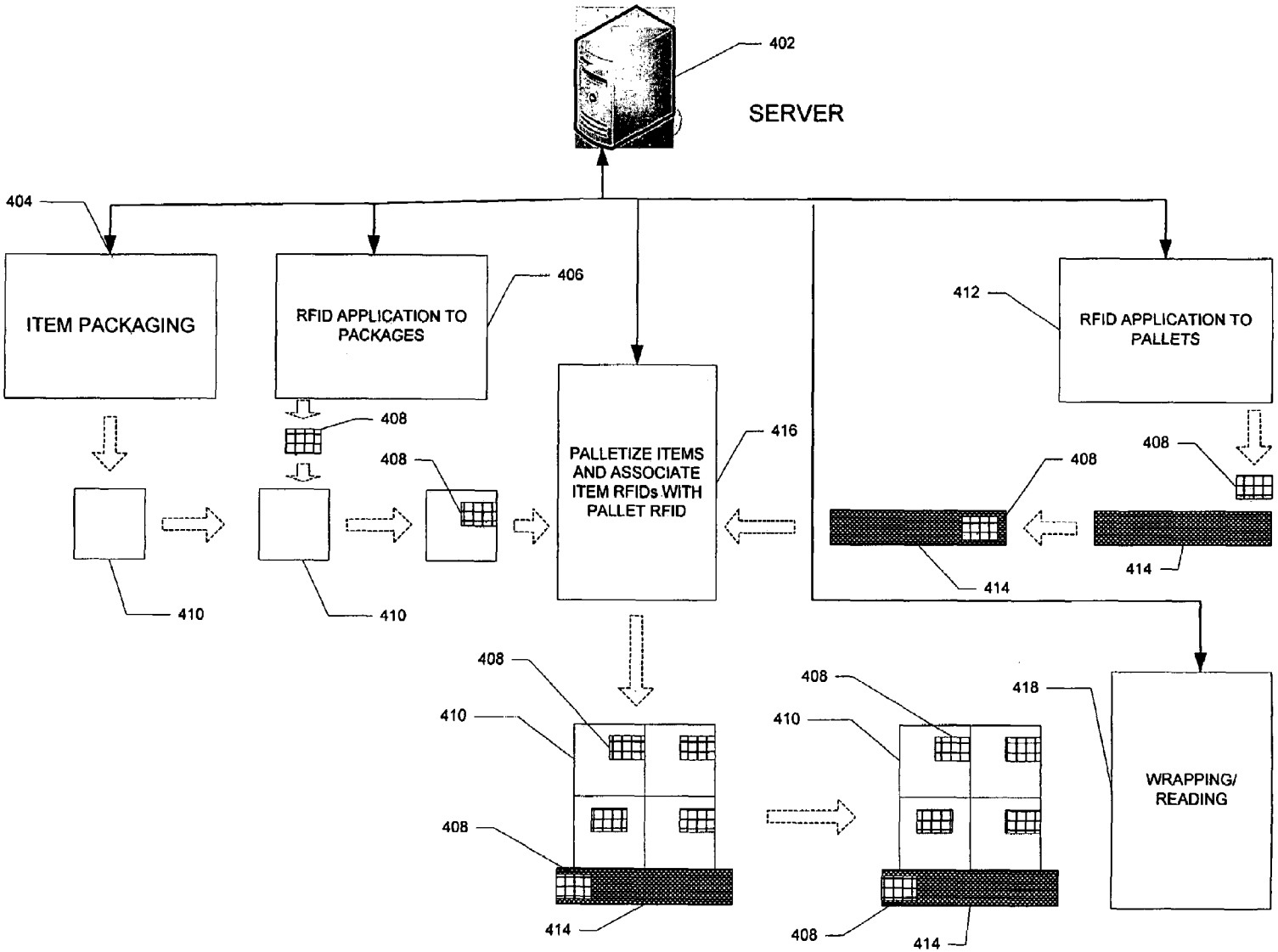
FIG. 4 is an exemplary processing facility wherein an embodiment of a pallet wrapper having a cooperatively adapted RFID reader, such as the one illustrated in FIGS. 3A and 3B, is incorporated into the processes of the facility.

FIG. 4 is an exemplary processing facility wherein an embodiment of a pallet wrapper having a cooperatively adapted RFID reader, such as the one illustrated in FIGS. 3A and 3B, is incorporated into the processes of the facility. In FIG. 4, a server 402 integrates the operations of the exemplary facility, including an item packaging process 404, a process 406 involving the application or association of RFID tags 408 with the packaged items 410, a process 412 for the application of an RFID tag 408 to a pallet 414, a process 416 for placing the packaged items 410 having RFID tags 408 on a pallet 414 having a RFID tag 408 and associating the RFID tags 408 of the packaged items 410 with the RFID tag 408 of the pallet 414, and a process 418 for reading the RFID tags 408 on the packaged items 410 and the pallet 414 as the pallet 414 and the packaged items 410 are wrapped for shipping with a shipping membrane. The devices and processes of FIG. 4 communicate with each other and with the server via a network 420 that may be comprised of one or more of wired, wireless, optical and electromagnetic transmissions of information. In the embodiment of FIG. 4, the server 402 may be used to link a pallet's 410 RFID tag 408 with each of the RFID tags 408 of the packaged items 410 that are placed on that pallet 414. In this manner, a count can be taken off all the packaged items 410 and, thus, the RFID tags 408 that are associated with a particular pallet 414 as unique identification information may be encoded into each RFID tag 408 for the pallet 414 and the packaged items 410.

In one instance, the wrapping/reading process 418 reads the RFID tag 408 information on a pallet 414 as the pallet 414 is brought into a wrapping area. The server 402 can be accessed with the information read from the pallet's 414 RFID tag 408 and the count of packaged items 410 associated with that pallet 414 can be obtained. The wrapping/reading device 418 can then be instructed to read the RFID tags 408 associated with the pallet 4141 until it matches the count of packaged items 410 that are associated with that pallet 414. If the number of read RFID tags 408 does not equal the count of FID tags provided by the server 402, then an alert can be provided.

Figure 5:
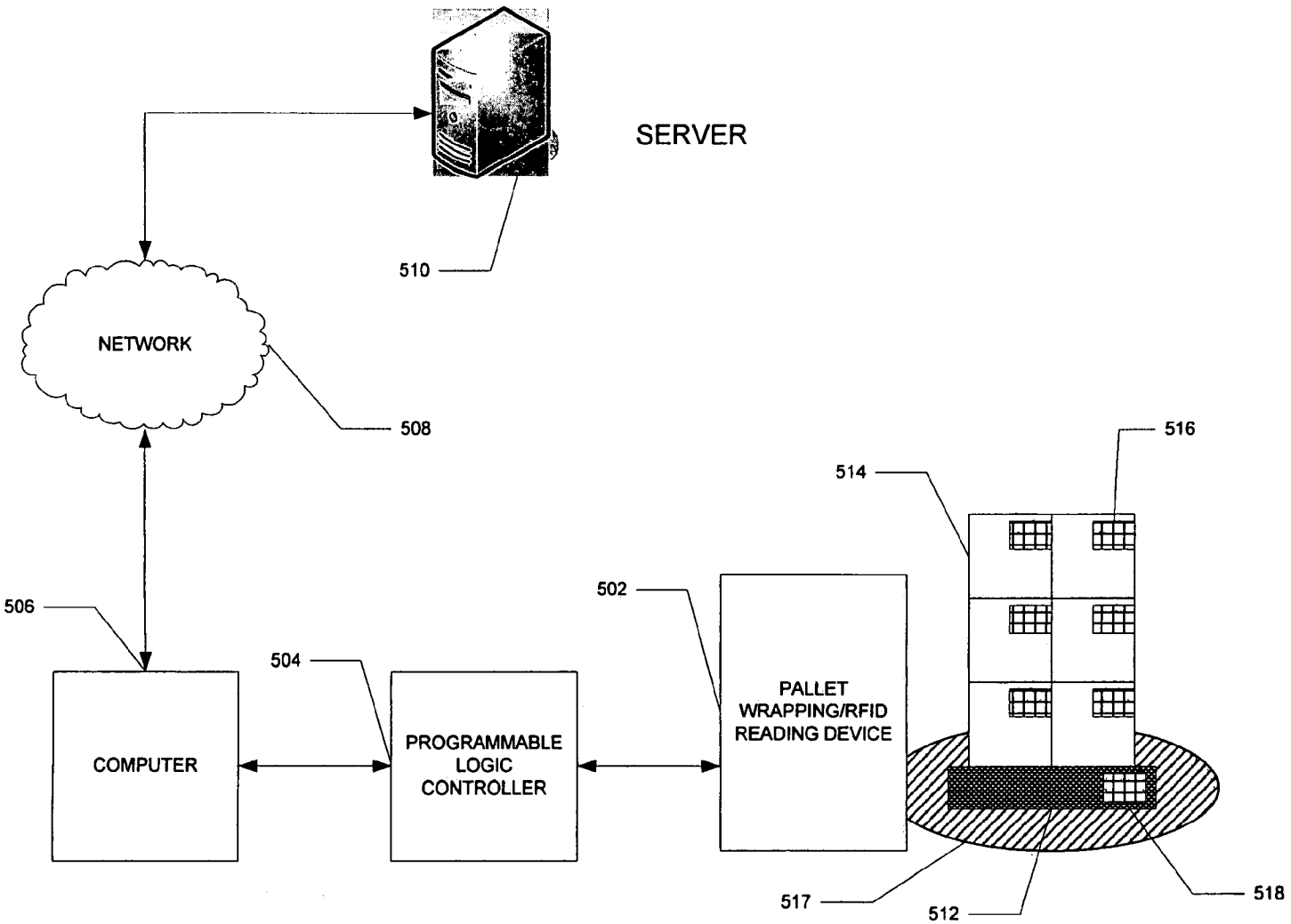
FIG. 5 is an embodiment of the invention where a pallet wrapping device adapted to operate with an RFID transponder reading device is controlled by a programmable logic controller, as are known in the art, which interfaces with a computer.

FIG. 5 is an embodiment of the invention where a pallet wrapping device 502 adapted to operate with an RFID transponder reading device is controlled by a programmable logic controller 504, as are known in the art, which interfaces with a computer 506. The computer 506 may have one or more data input and data display devices, as previously described herein, including, in one embodiment, a touch screen. The computer 506, in the embodiment of FIG. 5, is connected over a network 508 to a server 510, though in other embodiments the computer 506 may be stand-alone and not connect to a server.

The computer 506 is able to receive instructions either locally or from the server 510 for controlling the pallet wrapping device 502 and the RFID reading device. The instructions are carried out by means of the programmable logic controller 504 by receiving control signals from the computer 506 and executing said control signals. Instructions received from the computer 506 include how many wraps of shipping membrane to wrap the pallet 512 and items 514, how many RFID tags 516 are to be read for a particular pallet 512, whether to continue reading after all the designated wraps have been applied to the pallet 512 and items 514, the speed at which the pallet 512 and items 514 are to be turned by the turntable 517 of the pallet wrapping device 502, shut-down signals, etc. The computer 506 may also receive signals from the pallet wrapping device 502 via the programmable logic controller 504 including the number of RFID tags 516 read for a particular pallet 512, encoded information read from a pallet RFID tag 518 and the RFID tags 516 of the items 514 as read by the RFID reader of the pallet wrapping device, etc.

The server 510, in addition to its connection to the computer 506 via the network 508, may be connected to other processes, devices, systems and databases including, for example, rules engines that contain a businesses shipping rules for shipping items, inventory management systems including databases of stock items and items shipped, process control systems, shipping systems, carrier management systems, the Internet, etc., wherein such systems, devices, processes, and databases can control and monitor the pallet wrapping device 502 with its adapted RFID reader and receive, store, or transmit information to the pallet-wrapping device 502 or its associated computer 506.

One embodiment of the system of FIG. 5 comprises a commercially-available pallet wrapper 502, as such devices are readily-available from manufacturers such as, for example, Wulftec International, Inc. of Ayer's Cliff, Quebec (Canada), or other manufacturers. The controls of the pallet wrapper 502 are integrated into the programmable logic controller (PLC) 504, which is interfaced with the computer 506. The PLC 504 may be one that is available from suppliers such as, for example, Allen-Bradley, a division of Rockwell Automation of Milwaukee, Wis. The computer 506 may be a point-of-sale type computer that are known in the art, or any other computer having a touch-screen or easily-operable input device for interfacing with the PLC 504 and the control system of the pallet wrapper 502. The pallet wrapper 502 and its controls are cooperatively adapted to work with one or more RFID readers that may be mounted at one or more locations on or about the pallet reader 502. The RFID readers are also controlled by the PLC 504 and receive as well as transmit information to the computer 506. The RFID readers are generally commercially-available products available from suppliers such as, for example, Texas Instruments Incorporated of Dallas, Tex.

DESCRIPTION OF THE METHODS

FIG. 6A is a flowchart that describes an embodiment of a method of an invention for reading RFID tags associated with one or more items as such items are rotated about an axis located substantially at the midpoint of the one or more items. This process is also illustrated in FIGS. 2A and 2B. In FIG. 6A, the process starts at Step 602. At Step 604, each of one or more items that are each associated with at least one RFID tag are rotated in a horizontal plane about an imaginary axis through the midpoint of the one or more items. At Step 606, an RFID reader reads the RFID tags associated with the one or more items while they are being rotated. Generally, the RFID reader remains stationary, though in other embodiments it may be capable of movement in the vertical and/or horizontal planes. The process ends at Step 608.

FIG. 6B is a flowchart that describes an embodiment of a method of an invention for reading RFID tags associated with one or more items as such items are rotated in a horizontal plane substantially about or ore more fixed RFID tags. This process is also illustrated in FIGS. 2E and 2F. In FIG. 6B, the process starts at Step 610. At Step 612, each of one or more items that are each associated with at least one RFID tag are rotated in a horizontal plane substantially about one or more fixed RFID readers. At Step 614, the one or more fixed RFID readers read the RFID tags associated with the one or more items while the items are rotated substantially about the RFID readers. The process ends at Step 616.

FIG. 6C is a flowchart that describes an embodiment of a method of an invention for reading RFID tags associated with one or more items as one or more RFID readers are rotated in a horizontal plane substantially about the one or more items. This process is also illustrated in FIGS. 2C and 2D. In FIG. 6B, the process starts at Step 618. At Step 620, one or more RFID readers are rotated in a horizontal plane substantially about one or more items with each item being associated with at least one RFID tag. At Step 622, the one or more fixed RFID readers read the RFID tags associated with the one or more items while the RFID readers are rotated substantially about the one or more items. Generally, the items will remain stationary while the RFID readers rotate substantially about them. The process ends at Step 624.

FIG. 7 is flowchart that describes an embodiment of a method of an invention for reading RFID tags associated with one or more items as such items are rotated. The process starts at Step 702. At Step 704, an RFID tag is affixed to each of one or more items. At Step 706, the one or more items each having an affixed RFID tag are placed on a shipping pallet. At Step 708, the pallet with the items placed thereon is placed on a portion of the pallet wrapper that cause the pallet and the items thereon to rotate, wherein the pallet wrapper has been adapted with at least one RFID reader, as previously described herein. At Step 710, the pallet wrapper wraps a shipping membrane around at least a portion of the pallet and the items while the pallet and items are rotated. A carriage is provided on the pallet wrapper and the shipping membrane is mounted on the carriage. As the pallet rotates, the shipping membrane is wrapped about at least a portion of the pallet and the items and tension is applied to the shipping membrane with the carriage. The carriage is also capable of moving in the vertical plane so that the membrane cane be applied to varying heights of the pallet and items. In one embodiment of the pallet wrapper, the RFID reader or at least an antenna of the RFID reader are mounted on the carriage. Simultaneous to the application of the shipping membrane to at least a portion of the pallet and the items, the RFID tags on the one or more items are read with the RFID reader as the pallet and the items are rotated.

At Step 712, the rotation of the pallet and the items continues until the wrapping is complete and either all the RFID tags associated with the items have been read or until no more RFID tags are being read by the RFID reader. The process ends at Step 714.

FIG. 8 is flowchart that describes an embodiment of a method of an invention for reading RFID tags associated with one or more items as such items are rotated. The process starts at Step 802. At Step 804, an RFID tag is affixed on each of one or more items. At Step 806, a shipping pallet having an associated RFID tag is provided. At Step 808, the one or more items each having an affixed RFID tag are placed on a shipping pallet. At Step 810, the RFID tags affixed to the each of one or more items, and at least a portion of the information encoded thereon, are linked with the RFID tag of the pallet, and a least a portion of the information encoded thereon. This may be accomplished electronically by, for example, the use of a relational database, though other means may be utilized. At Step 812, the pallet with the items placed thereon is placed on a portion of the pallet wrapper that cause the pallet and the items thereon to rotate, wherein the pallet wrapper has been adapted with at least one RFID reader, as previously described herein. At Step 814, the RFID tag, and at least a portion of the information encoded thereon, is read by the RFID reader of the pallet wrapper. By accessing the linked information about items that are associated with the pallet RFID information, the number of items on the pallet can be determined, as well as the number of RFID tags that should be read on the pallet. At Step 816, the pallet wrapper wraps a shipping membrane around at least a portion of the pallet and the items while the pallet and items are rotated. A carriage is provided on the pallet wrapper and the shipping membrane is mounted on the carriage. As the pallet rotates, the shipping membrane is wrapped about at least a portion of the pallet and the items and tension is applied to the shipping membrane with the carriage. The carriage is also capable of moving in the vertical plane so that the membrane cane be applied to varying heights of the pallet and items. In one embodiment of the pallet wrapper, the RFID reader or at least an antenna of the RFID reader are mounted on the carriage. Simultaneous to the application of the shipping membrane to at least a portion of the pallet and the items, the RFID tags on the one or more items are read with the RFID reader as the pallet and the items are rotated.

At Step 818, the rotation of the pallet and the items continues until the wrapping is complete. At Step 820, a comparison is made to determine whether all items having RFID tags that are linked with the RFID tag information of the pallet have been read. If all the RFID tags of the items on that pallet have been read, then the process ends at Step 822. If, at Step 820, all the RFID tags associated with items on that pallet have not been read, then at Step 824 it is determined whether the attempted read time limit exceeds a certain predetermined time limit. If the predetermined time limit is exceeded, then at Step 826 an alert is provided that RFID tags associated with items on that particular pallet have not been read, and at Step 822, the process ends. If, at Step 824, the predetermined time limit has not been exceeded, then the process goes to Step 828 where the pallet and items will continue to be rotated in the horizontal plane while the carriage and the RFID reader move in the vertical plane in an attempt to read the missing RFID tags. The process then goes to Step 820, as described above. This process continues until all the RFID tags associated with items have been read, or the predetermined time limit is exceeded.

Thus, the embodiments of the present invention describe systems and methods for the rotational reading of RFID tags. Specifically, the embodiments of the present invention describe systems and methods for the rotational reading of RFID tags that have been associated with items, the items placed on a pallet, and during the wrapping of at least a portion of the pallet and the items with a shipping membrane. The rotation of the items having associated RFID tags exposes the tags to a reader at a multitude of angles and distances thus facilitating the capturing of the information encoded on the items' RFID tags.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for reading RFID transponders, said system is comprised of:

one or more items each having at least one RFID transponder associated therewith or affixed thereto;

one or more RFID readers capable of reading encoded information on each of the RFID transponders;

a rotational device capable of rotation, wherein said one or more items each having at least one RFID transponder associated therewith or affixed thereto are placed upon said rotational device and rotated while said one or more RFID readers remain at a fixed point and read information from said RFID transponders;

a pallet, wherein said one or more items are placed on said pallet and said pallet and said one or more items are placed on said rotational device for reading said RFID transponders while rotating; and a pallet RFID transponder, wherein the pallet RFID transponder is affixed or associated with the pallet;

wherein the pallet RFID transponder is electronically linked to the RFID transponders associated with or affixed to each of the items and the number of items having RFID tags on the pallet can be determined, and wherein said rotational device continues to rotate said items and read said RFID transponders until all the RFID transponders on the pallet have been read or until a predetermined time limit has passed.

2. A system for reading RFID transponders, said system is comprised of:

one or more items each having at least one RFID transponder associated therewith or affixed thereto;

one or more RFID readers capable of reading encoded information on each of the RFID transponders;

a rotational device capable of rotation, wherein said one or more items each having at least one RFID transponder associated therewith or affixed thereto are placed upon said rotational device and rotated while said one or more RFID readers remain at a fixed point and read information from said RFID transponders;

a pallet, wherein said one or more items are placed on said pallet and said pallet and said one or more items are placed on said rotational device for reading said RFID transponders while rotating; and a pallet wrapper, wherein said pallet wrapper is comprised at least in part by said rotational device and a carriage device, wherein said carriage device is capable of moving substantially vertically relative to said one or more items and that holds a shipping membrane that is wrapped at least in part about said pallet and said one or more items as they are rotated on said rotating device, said carriage farther having attached thereto at least one of the RFID readers.

3. A system for reading RFID transponders, said system is comprised of:

one or more items each having at least one RFID transponder associated therewith or affixed thereto, wherein said one or more items are placed on a pallet; one or more RFID readers capable of reading encoded information on each of the RFID transponders;

a pallet wrapper, wherein said pallet wrapper is comprised at least in part by a rotational device capable of rotating and a carriage device that is capable of moving at least substantially vertically relative to said one or more items and said carriage device holds a shipping membrane that is wrapped at least in part about said pallet and said items as they are rotated on said rotating device, said carriage further having attached thereto at least one of the RFID readers and said pallet with one or more items each having at least one RFID transponder associated therewith or affixed thereto are placed upon said rotational device and rotated while said one or more RFID readers read information from said RFID transponders.

4. The system of claim 3 farther comprising a pallet RFID transponder, wherein the pallet RFID transponder is affixed to or associated with the pallet.

5. The system of claim 4 wherein the pallet RFID transponder is electronically linked to the RFID transponders associated with or affixed to each of the items and the number of items having RFID tags on the pallet can be determined.

6. The system of claim 5, wherein said rotational device continues to rotate said items and read said RFID transponders until all the RFID transponders on the pallet have been read or until a predetermined time limit has passed.

7. An improved pallet-wrapping apparatus, said pallet wrapping apparatus comprised of:

a rotational platform that is capable of rotation, wherein one or more items at least a portion of which are associated with RFID transponders, are placed on a pallet and said pallet with said items is placed on said rotational platform;

a programmable logic controller adapted to control said pallet wrapping apparatus; a computer that interfaces with at least said programmable logic controller; wherein said computer includes a display capable of displaying operating characteristics of said pallet wrapping apparatus and an input device for receiving operating instructions for said pallet wrapping apparatus;

a carriage device, wherein said carriage device is capable of moving substantially vertically relative to said one or more items and said carriage device holds a shipping membrane that is wrapped at least in part about said pallet and said items as they are rotated on said rotational platform, said carriage further having attached thereto at least one RFID reader and said pallet with said items with said RFID transponders associated therewith are placed upon said rotational platform and rotated while said at least one RFID reader reads information from said RFID transponders until all the RFID transponders on the pallet have been read or until a predetermined time limit has passed.

8. A method of reading RFID transponders, comprising:

providing one or more items having affixed RFID transponders;

providing at least one RFID reader; and placing said one or more items on a rotational device and simultaneously rotating said items about an imaginary axis approximately through the midpoint of said one or more items and reading said affixed RFID transponders with said at least one RFID reader, wherein said rotational device continues to rotate said one or more items and read said RFID transponders until all the RFID transponders affixed to the one or more items have been read or until a predetermined time limit has passed.

9. A method of reading RFID transponders, comprising:

providing one or more items having affixed RFID transponders;

providing at least one RFID reader; and placing said one or more items on a rotational device and simultaneously rotating said items substantially about said at least one RFID reader and reading said affixed RFID transponders with said at least one RFID reader, wherein said rotational device continues to rotate said one or more items and read said RFID transponders until all the RFID transponders affixed to the one or more items have been read or until a predetermined time limit has passed.

10. A method of reading RFID transponders, comprising:

providing one or more items having affixed RFID transponders;

providing at least one RFID reader; and rotating said at least one RFID reader substantially about said items and reading said affixed RFID transponders with said at least one RFID reader, wherein said at least one RFID reader continues to rotate substantially about said one or more items and read said RFID transponders until all the RFID transponders affixed to the one or more items have been read or until a predetermined time limit has passed.

11. A method of reading RFID transponders, comprising:

providing one or more items and affixing at least one RFID transponder to each of said one or more items;

placing said one or more items on a pallet;

providing at least one RFID reader;

placing said pallet with said one or more items on a rotational device and simultaneously rotating said items about an imaginary axis approximately through the midpoint of said one or more items and reading said affixed RFID transponders with said at least one RFID reader; and rotating said pallet with said one or more items and reading said RFID transponders until all the RFID transponders affixed to the one or more items have been read or until a predetermined time limit has passed.

12. A method of reading RFID transponders, comprising:

providing one or more items and affixing at least one item RFID transponder to each of said one or more items;

placing said one or more items on a pallet, wherein said pallet has an affixed pallet RFID transponder;

electronically linking said one or more item RFID transponders to said pallet RFID transponder;

encoding said affixed pallet RFID transponder with at least a count of the items on said pallet having said affixed item RFID transponders;

providing at least one RFID reader;

placing said pallet with said one or more items on a rotational device;

reading said pallet RFID transponder to determine at least the count;

wrapping a shipping membrane around at least a portion of said pallet and said items while simultaneously reading and counting said item RFID transponders with said at least one RFID reader while said pallet and said items are rotated on said rotational device about an imaginary axis approximately through the midpoint of said one or more items and reading said affixed RFID transponders with said at least one RFID reader until the wrapping is complete and determining a pallet item count that is equal to the number of item RFID transponders that have been read by the at least one RFID reader; and comparing the pallet item count to the count and signaling an alert or continuing reading the item RFID transponders if the number of item RFID transponders is not equal to the count.

* * * * *